United States Patent [19]

Brunier

[11] Patent Number: 4,653,746

[45] Date of Patent: Mar. 31, 1987

[54] SPORT APPARATUS FOR TRAINING IN BOXING AND IN THE MARTIAL ARTS

[76] Inventor: Michel Brunier, 20bis, rue de Parmain, Butry sur Oise, 95430 Auvers sur Oise, France

[21] Appl. No.: 679,298

[22] Filed: Dec. 7, 1984

[51] Int. Cl.[4] ..... A63B 67/00; A63B 69/00

[52] U.S. Cl. ..... 272/78; 273/55 R

[58] Field of Search ..... 272/76, 77, 78; 273/55 R, 55 A, 411

[56] References Cited

U.S. PATENT DOCUMENTS

| | | | |
|---|---|---|---|
| 1,512,367 | 10/1924 | Sandeberg . | |
| 1,733,709 | 10/1929 | Zinnow et al. | 272/78 |
| 2,085,161 | 6/1937 | Kraus | 272/78 |
| 2,156,831 | 5/1939 | Andre | 272/77 |
| 2,496,795 | 2/1950 | Johnson | 272/78 |
| 2,620,188 | 12/1952 | Malagio | 272/78 |
| 2,632,977 | 3/1953 | Valasek | 273/55 R |
| 3,022,072 | 2/1962 | Zinnow | 272/78 |
| 3,387,842 | 6/1968 | Edgar . | |
| 4,050,693 | 9/1977 | Lichterman | 272/78 |

FOREIGN PATENT DOCUMENTS

| | | | |
|---|---|---|---|
| 640360 | 1/1935 | Fed. Rep. of Germany . | |
| 1325472 | 3/1963 | France | 272/78 |
| 24318 | of 1911 | United Kingdom . | |
| 435740 | 9/1935 | United Kingdom | 272/78 |
| 1483017 | 7/1976 | United Kingdom . | |

*Primary Examiner*—Richard J. Apley
*Assistant Examiner*—S. R. Crow
*Attorney, Agent, or Firm*—Michael N. Meller

[57] ABSTRACT

Sport apparatus for training in boxing and in the martial arts and similar exercises, comprising an elongate stuffed target (12) suspended from a support (12) by means of a link the link being dismountable, of adjustable length, and connected to the lower end of a spring member whose upper end is connected to the support.

7 Claims, 4 Drawing Figures

SPORT APPARATUS FOR TRAINING IN BOXING AND IN THE MARTIAL ARTS

The present invention relates to sport apparatus intended for use in training in boxing and in the martial arts and similar exercises in which users make use of their fists, feet, elbows and knees for striking a padded elongate target which is suspended from a suitable support.

BACKGROUND OF THE INVENTION

Two principal types of sport apparatus for use in such in such training are currently known, namely: punch bags and punch balls.

Punch bags are made in various sizes, but they are generally big enough to perform most of the above-mentioned sporting exercises. Such bags are suspended at the end of a rope or chain and they can be made with varying degrees of hardness depending on the stuffing used. They are more particularly intended for working on the force with which punches are delivered and for pure technique. However, because of their relatively large size and weight, they are incapable of moving rapidly and thus do not exercise the reflexes, nor speed and accuracy in attacking and dodging.

Punch balls are constituted by generally football-sized balls which are intended to be punched with the fists only and which are connected to at least one dynamic member which is generally mounted on a stand.

Punch balls are apparatuses created for training in English-style boxing and for the training techniques specific to this art. However they have two main drawbacks:

they limit the movements of the user to well determined levels because of the small size of the target which is roughly the size of an opponent's head, and which is usually placed at face level; and they cannot be used with any kind of realistic training for various combat sports in which the technique is based mainly on a range of blows running between the abdomen and the head of the opponent.

One of the aims of the present invention is to provide a new training apparatus which, while being related to punch bags, nonetheless possesses its own dynamic characteristics suitable for improving reflexes, and the speed and accuracy of the user's blows.

SUMMARY OF THE INVENTION

This aim is achieved by the invention by proposing a sport apparatus of the above type in which the target is connected by a dismountable link of adjustable length to the lower end of a spring member whose upper end is connected to a support.

This thus provides a suspended target in the form of a punch bag, which target is connected to a dynamic member enabling it to respond actively to the user's blows and to simulate the movements of an opponent, unlike traditional punch bags which are heavy and static.

By means of the dismountable link and the adjustable length between the target and the spring member, the target may easily be interchanged with other targets. It is thus possible to have a complete range of targets having various different characteristics such as shape, volume, length, etc., each target being intended for a particular type of training. Further, the possibility of adjusting the link between the target and the spring member makes it possible to modify the amplitude and the speed of the rocking movement of the target under the effect of the blows which it receives.

The apparatus in accordance with the invention thus makes it possible to train for various boxing techniques requiring attack between the legs and the head of the opponent, and for various dodging techniques which become possible due to the large amplitude and the speed of the movements of the target, to the narrow width of the target and to its suspended disposition which increases its speed.

In a preferred embodiment of the invention, the target comprises a reinforcing tube whose lower end is inserted into the target and whose upper end is provided with a clamping ring.

This clamping ring serves to hold the target at a desired height relative to the tube to which it serves as an extender capable of sliding axially inside the reinforcing tube, with the upper end of the sliding tube being fixed to the spring member.

Advantageously, the said upper end of the sliding tube is rotatably mounted inside a ring serving as a bearing and fixed to the lower end of the spring member. In this way, the target of the apparatus in accordance with the invention may not only rock under the effect of a blow, it may also rotate. The movement of the target thus comes closer to that of an opponent and it is possible, by providing the target with a mark representing the face of an opponent, to adapt the sequence of blows to the position of the target.

BRIEF DESCRIPTION OF THE DRAWING

An embodiment of the invention is described by way of example with reference to the accompanying drawing, in which:

FIG. 1 is an elevation view in partial section of an apparatus in accordance with the invention;

MORE DETAILED DESCRIPTION

Figure 2:
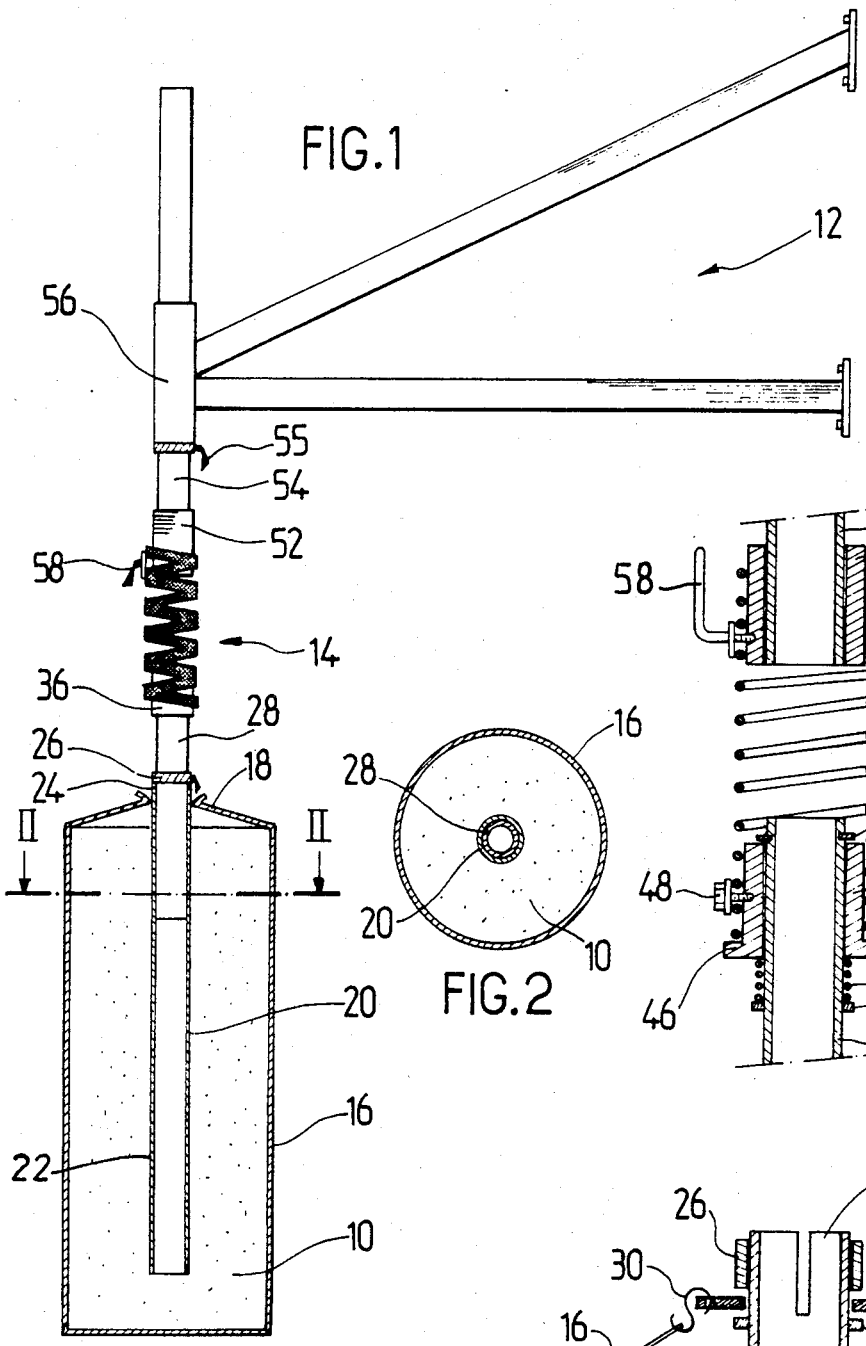
FIG. 2 is a horizontal section on a line II—II in FIG. 1.

The apparatus shown by way of example in FIG. 1 comprises a target 10 suspended from a support 12 by means of a spring member 14. The target 10 is generally cylindrical in shape and is made of dense polyurethane foam covered by an envelope 16 having an open upper end 18. A reinforcing tube 20 is disposed axially inside the target 10 in such a manner that its lower end 22 is inserted into the target while its upper end 24 projects above the target (FIGS. 1 and 2).

Figure 4:
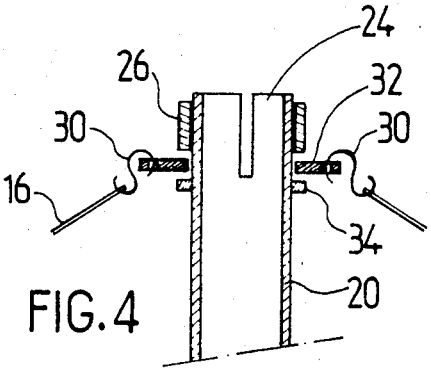
FIG. 4 is a section through the link between the target envelope and the upper end of the reinforcing tube.

As shown in FIG. 4, the upper end 24 is axially split and is provided with a clamping ring 26 to lock the tube 20 on another tube 28 as is explained below.

As can also be seen in FIG. 4, the opening 18 in the envelope 16 is connected by suitable means, in particular by S-shaped hooks 30, to a flat ring 32 which is free to rotate about the end 24 between the fixing ring 26 and a retaining flange 34 mounted on the tube 20.

The tube 28 serves as an extension and is suitable for sliding axially inside the tube 20 and for being locked therein in a desired position by means of the clamping ring 26.

By virtue of this characteristic, the amplitude or "swing" and the speed of the target may be adjusted and it is also easy to change the target for another target having different characteristics.

Figure 3:
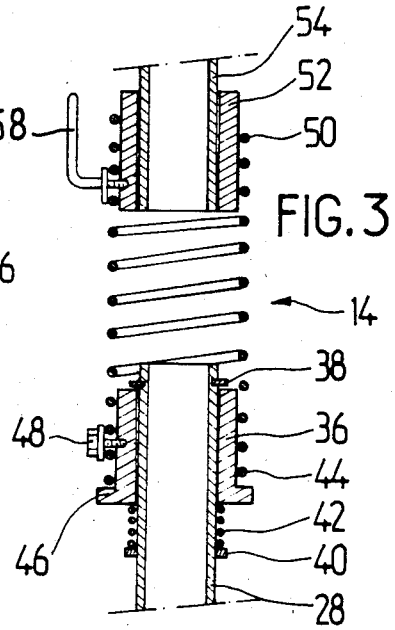
FIG. 3 is a detailed view on a larger scale showing the connection between the spring member and the link.

The upper end of the tube 28 is lodged inside a ring 36 which serves as a bearing and which is itself fixed to the bottom end of the spring member 14. The upper end of the tube 28 has an annular groove in which a spring clip 38 is received and projects outwardly to rest on the upper end of the ring 36 (FIG. 3). Around the tube 28 between the lower portion of the ring 36 and a retaining flange 40 which is fixed to the tube 28, there is a compression spring 42. This spring constitutes a member which brakes rotation and resists axial displacement of the tube 28 inside the ring 36.

The spring member 14 is constituted by a helical spring whose lower end 44 fits around the ring 36 and abuts against a shoulder 46 on said ring. The spring 14 is fixed to the ring 36 by means of a clamping screw 48 which is inserted between two consecutive turns of the spring and is screwed into the ring 36 (FIG. 3).

The upper end 50 of the spring 44 is threaded over a reinforcing ring 52 provided at the lower end of a tube 54 connected to the support 12. More particularly, the tube 54 slides inside a vertical sleeve 56 which constitutes a portion of the support 12. The tube 54 is adjustable in position by means of a handle 55 inside the sleeve 56 thereby enabling the height of the target to be adjusted. The support 12 may be constituted by any suitable support, in particular by means of a wall-mounted support, as shown in the drawings.

The position of the upper end 50 of the spring 14 relative to the ring 52 may be adjusted by means of a clamping handle 58 engaged between two consecutive turns and screwed into the ring 52. It is thus possible to modify the available stroke of the spring and consequently to modify its dynamic characteristics, since the target reacts quicker or slower depending on the effective length of the spring. It can thus be seen that the apparatus shown in FIG. 1 is capable of several kinds of adjustment: one target may rapidly be interchanged for another; the amplitude and the speed of the movements of the target may be adjusted by means of the ring 26; the dynamics of the target reaction as a function of the stroke of the spring member may be adjusted; and the height of the apparatus relative to the support may be adjusted. It is preferable for the lower end 22 of the tube 20 to be at a distance from the bottom of the envelope to enable the user to maneuver underneath the target and to strike the lower face without risk of injury. A target made in this manner is particularly light by virtue of the material used and is particularly strong because of the reinforcing tube which extends over practically the entire length of the target and also by virtue of the outer protecting envelope.

The target may be made to various sizes, for example having a length in the range 50 centimeters to 1.2 meters, and a diameter of about 20 centimeters.

The spring member neet not necessarily be a helical spring, it could also be constituted from a material having equivalent properties, e.g. a flexible link made of glass fibers.

The target may be stuffed with any suitable light material, or it may be inflatable.

What is claimed is:

1. Sport apparatus suitable for training in boxing and in the martial arts and in similar exercises in which users make use of their fists, feet, elbows and knees for striking an elongate stuffed target suspended from a support, said apparatus comprising a support means, a spring member attached at its upper end to said support means, a target, an axial reinforcing tube for said target and having its lower end inserted in said target, a sliding tube serving as an extension capable of sliding axially within said reinforcing tube and having its upper end attached to said spring member, and a clamping ring at the upper end of said reinforcing tube for adjustably clamping said reinforcing tube along the length of said sliding tube, whereby said target is held at an adjustable height along said sliding tube and is dismountable therefrom.

2. Sport apparatus according to claim 1, wherein the upper end of the sliding tube is rotatably mounted inside a ring which serves as a fixed bearing at the lower end of the spring member.

3. Sport apparatus according to claim 2, wherein a member is provided for braking rotation and for preventing axial displacement of the sliding tube inside the bearing ring.

4. Sport apparatus according to claim 1, wherein the spring member includes adjusting means for modifying the dynamic characteristics of the spring member.

5. Apparatus according to claim 1, wherein the target is generally cylindrical, is made of dense polyurethane foam, and is covered by an envelope.

6. Apparatus according to claim 5, wherein the envelope includes an opening connected to a flat ring freely mounted about the upper end of the reinforcing tube, between the clamping ring and a retaining flange.

7. Sport apparatus according to claim 1, wherein the target is provided with an adjustable mark reproducing an opponent's face.

* * * * *